US005302324A

United States Patent [19]

Morikawa et al.

[11] Patent Number: 5,302,324

[45] Date of Patent: Apr. 12, 1994

[54] METHOD FOR DECONTAMINATING SUBSTANCES CONTAMINATED WITH RADIOACTIVITY, AND METHOD FOR DECONTAMINATING THE MATERIALS USED FOR SAID DECONTAMINATION

[75] Inventors: Kenji Morikawa; Yasuo Shimizu, both of Kohshoku; Akira Doi, Toguramachi, all of Japan

[73] Assignee: Morikawa Sangyo Kabushiki Kaisha, Kohshoku, Japan

[21] Appl. No.: 671,940

[22] Filed: Mar. 19, 1991

[30] Foreign Application Priority Data

Mar. 20, 1990 [JP] Japan ..... 2-71144

[51] Int. Cl.[5] ..... G21F 9/00

[52] U.S. Cl. ..... 252/626; 134/1; 134/7; 134/10; 134/11; 134/12; 134/26; 976/DIG. 376; 51/320

[58] Field of Search ..... 252/626; 134/7, 10, 134/12, 11, 26, 1, 2; 976/DIG. 376; 51/320

[56] References Cited

U.S. PATENT DOCUMENTS

| | | | |
|---|---|---|---|
| 3,007,814 | 11/1961 | Bulat | 252/626 |
| 3,013,900 | 12/1961 | Dancer et al. | 252/626 |
| 3,080,262 | 3/1963 | Newman | 252/626 |
| 3,427,763 | 2/1969 | Maasberg et al. | 51/411 |
| 3,778,938 | 12/1973 | Korn et al. | 51/411 |
| 3,894,364 | 7/1975 | Korn et al. | 51/320 |
| 3,895,465 | 7/1975 | Korn et al. | 51/320 |
| 4,443,269 | 4/1984 | Capella et al. | 134/12 |
| 4,633,623 | 1/1987 | Spitz | 51/439 |
| 4,724,853 | 2/1988 | Hirose | 134/1 |
| 4,771,579 | 9/1988 | Giese | 51/425 |
| 4,800,063 | 1/1989 | Mierswa et al. | 376/316 |
| 4,906,302 | 3/1990 | Bruya | 134/10 |
| 4,936,922 | 6/1990 | Cherry | 134/22.18 |
| 4,940,494 | 7/1990 | Petit et al. | 134/1 |
| 4,963,293 | 10/1990 | Burack et al. | 252/626 |
| 5,046,289 | 9/1991 | Bengel et al. | 51/411 |
| 5,087,374 | 2/1992 | Ding | 210/673 |
| 5,094,696 | 3/1992 | Orsen | 134/38 |

OTHER PUBLICATIONS

Ayres, J. A. Decontamination of Nuclear Reactors and Equipment pp. 376–390.

*Primary Examiner*—Donald P. Walsh
*Assistant Examiner*—Ngoclan T. Mai
*Attorney, Agent, or Firm*—William L. Klima

[57] ABSTRACT

Applying shotblast or sandblast to a substance contaminated with radioactivity, cleaning the substance with a liquid, washing the grit of shotblast or sandblast with an organic solvent, filtering the resulting organic solvent, decontaminating the organic solvent itself by distilling the organic solvent filtered, and using this decontaminated solvent for washing said grit.

14 Claims, 4 Drawing Sheets

METHOD FOR DECONTAMINATING SUBSTANCES CONTAMINATED WITH RADIOACTIVITY, AND METHOD FOR DECONTAMINATING THE MATERIALS USED FOR SAID DECONTAMINATION

BACKGROUND OF THE INVENTION

1. Field of the Invention

The present invention relates to a method and an apparatus for the decontamination of a substance contaminated with radioactivity produced in a nuclear power station or the like, and to a method and an apparatus for the decontamination of a material used for said decontamination.

2. Description of the Prior Art

Heretofore, in a nuclear power station, with the passage of time substances contaminated with radioactivity are produced due to contact of apparatus and the parts thereof with radioactivity.

Such contaminated apparatus or parts are generated as replaced or disposed forms at the time when the apparatus are subjected to routine inspection or overhaul.

Otherwise, there occurs no replacement of the part, however, some apparatus contaminated are generated to be necessarily coated.

The degree of contamination of these contaminated substances can be out of the specified range according to safety standards. To dispose of these substances large size substances are cut into small size substances, contained in metal drums, and then they are usually confined in abandoned mines or the like, or kept or dumped in storage places which are constructed in regions with few inhabitants located apart from urban areas.

In the present invention, said terms "keeping and dumping" are unified as one word "dumping" for convenience.

The amount of substances contaminated with radioactivity stated above increases every year by the operation of nuclear power stations, resulting in lack of places to dump these substances. New waste-dumping places, therefore, become necessary. Then when a new waste-dumping place is selected, however, the inhabitants near the place tend to make an opposition movement leading to social problems. The present invention is intended to solve such troubles. The object of the invention is to provide a method and an apparatus for the decontamination of substances contaminated with radioactivity which comprises decontaminating substances contaminated with radioactivity as mentioned above, enabling the decontaminated substances to have less radioactivity than that required by safety standard, therefore, allowing the substances to be dealt with as general industrial wastes, and enabling the use of a greatly reduced area of waste-dumping place. Another object of the invention is to to provide a method and an apparatus for the decontamination of materials used for the decontamination of the substance mentioned above which comprise decontaminating fully said materials, regenerating the materials, and permitting the re-use thereof.

BRIEF SUMMARY OF THE INVENTION

The present invention is directed to provide a method for the decontamination of substance contaminated with radioactivity which comprises applying shotblast or sandblast to the substance to remove matters adhered to the surface of the substance, then cleaning the surface of the substance using liquid, washing the grit of said shotblast or sandblast with an organic solvent, filtering the organic solvent used for the washing, vaporizing the organic solvent comprising residue removed by heating, liquefying and recovering the vaporized solvent, and washing the washed grit with a solution containing a chelate compound.

In addition, as far as the decontaminating apparatus of the present invention is concerned, it is an apparatus for the decontamination of the substance contaminated with radioactivity comprising means for shotblasting or sandblasting; means for washing the grit of the shotblast or sandblast with an organic solvent; means for filtering washing liquid used for the washing; means for purifying which comprises heating said filtered washing liquid, liquefying and purifying by cooling; and means for washing using a liquid containing chelate compound.

Further, a method for decontaminating the material used for the decontamination mentioned above which comprises washing the grit of shotblast or sandblast, being applied to the substance contaminated with radioactivity, with an organic solvent, filtering the organic solvents used for the washing, vaporizing the filtered organic solvent by heating, liquefying and purifying the vaporized organic solvent by cooling, and washing said washed grit with a liquid containing chelate compound.

Further, as for a decontaminating apparatus for the material used for the decontamination of the substance contaminated with radioactivity, the apparatus comprising means for filtration being made corresponding to a means for washing the grit of shotblast or sandblast; means for purifying organic solvent which comprises evaporizing the organic solvent by heating and liquefying the solvent by cooling; and means for washing a chelate liquid using a solution containing chelate compound.

Further, a method of the decontamination of substances contaminated with radioactivity which comprises washing said substance by the use of a washing apparatus containing a liquid as well as having means for ultrasonic vibration.

Further, an apparatus for the decontamination of substances contaminated with radioactivity comprising a vessel containing a liquid as well as having means for ultrasonic vibration.

DESCRIPTION OF THE PREFERRED EMBODIMENT

Figure 4:
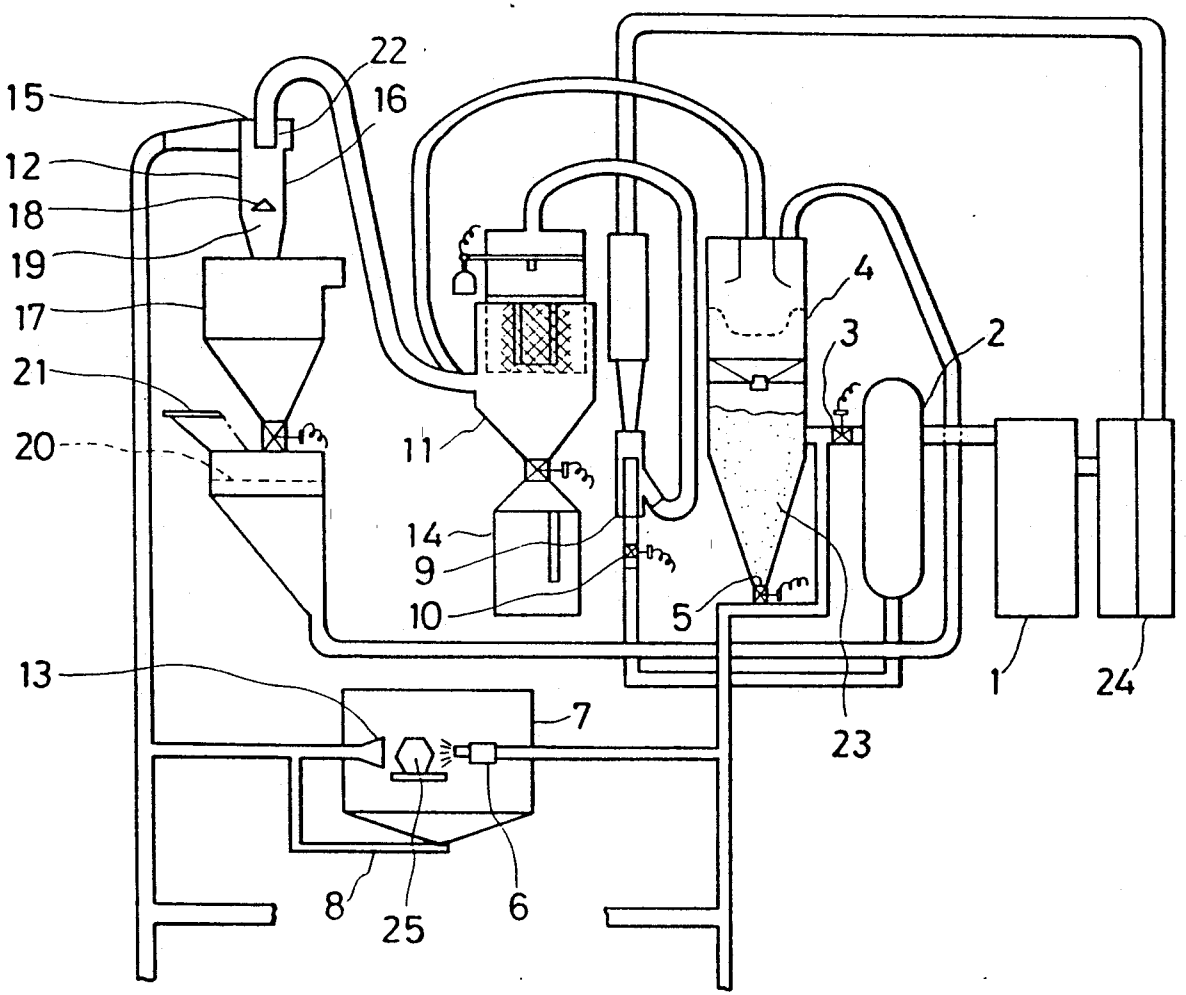
FIG. 4 shows a schematic representation of a decontaminating apparatus for the substance contaminated with radioactivity.

The apparatus shown in FIG. 4 is for the application of shotblast to the substance contaminated with radioactivity.

The present invention allows the application of sandblast, in place of shotblast and both blastings are available in the invention. Specifically, the grit for both blasting types can be used. Iron grit having a hemispherical shape, as an example, can be used. Alternatively, cut wire, sand or glass powder may be suitably used.

In said figure, numeral 1 indicates an air compressor wherein compressed air is held in an air tank 2, and grit is blasted through a nozzle 6 by the opening of valves 3 and 5 of the tanks 2 and 4, respectively. Numeral 7 indicates a cutting room and numeral 8 a connecting pipe. Numeral 9 designates an ejector type of negative pressure generating means connected to the tank 2, and is designed to operate by the opening of valve 10. The negative pressure generating equipment is connected to a sucking port 13 via a filter room 11 and separating means 12. Numeral 14 indicates a confining box for the cutting powder contaminated with radioactivity. The separating means 12 comprises a top cylinder 15, an intermediate cylinder 16 and a hopper 17. The intermediate cylinder 16 is equipped with conical reversing part 18. Numerals 19, 20 and 21 designate a gap, vibrating sieve and introducing port for fresh grits, respectively.

Said top cylinder 15 is formed around a discharge cylinder 22, and the entrance port thereof is formed in a tangental direction. The grit 23 and cutting powder go down inside of the intermediate cylinder 16 with whirling, then the cutting powder collides with a revering part 18 to turn reversely upward, and then leaves the discharge cylinder 22, enters the filter room 11 and is contained by the confining box. The greater mass of grit 23 whirls by centrifugal force near to the inside wall surface of the intermediate cylinder 16, then enters the hopper 17 through gap 19, and is allowed to be sucked by the grit tank 14. Numeral 24 indicates a sub-filter room.

Numeral 25 designates a substance contaminated with radioactivity and the position thereof is changed by the action of holding equipment not shown in the Figure so that all the surfaces of the substance may be exposed to grit blasting.

In this case, said substance 25, as an example, is an iron made part comprising non-corrodible coating applied thereon. The non-corrodible coating usually comprises an undercoating layer using zinc oxide-coating and a topcoating layer using epoxy resin-coating. While, as for the substances contaminated with radioactivity, there are those contaminated by the build-up of scale on a boiler, turbine, turbine blade, or a coated inner wall of a surging tank settled for sinking in an emergency. Generally, when the surface of metal has dust or the like solidified as a mixture with the coating, scale or oil, such adherent of dust can not be removed by only wiping, resulting in difficult decontamination.

Said substance 25, as an example, had 800 CPM (Counter Per Minute) when counted by a Geiger counter.

The surface coating layer adhered to the substance 25 was removed by the exposure of blasted grit from nozzle 6 by the action of a shotblasting apparatus shown in FIG. 4. The radioactivity of the substance 25 counted after said removal of coating was 120 CPM.

Then the substance was washed with methylene chloride as an example. The washing was conducted in a washing room connected to an adsorbing means using activated carbon (no figure thereof is shown). After the washing the radioactivity counted thereof, 30 CPM.

In the next operation, the substance 25 was rinsed with water containing chelate agent and surfactant, described later, in washing means using chelate liquid, and equipped with an ultrasonic vibrating means. The radioactivity count of the substance 25 after the washing was 0 CPM. According to a safety code, generally, the substance such as apparatus or the parts thereof having 0 CPM is permitted to be carried out of a nuclear power station or the like, and permitted to be subjected to treatment such as fusion and regeneration as in the case of general industrial wastes. The substances mentioned above, therefore, were carried out of the nuclear power station to be melted in a melting furnace for regeneration as metal material.

In said washing, Freon R113 and alcohols as well as methylene chloride are optionally used. And in place of washing, the substance can be cleaned by wiping using fabric and such solvents. After said washing, the washing liquid used is purified and separated by the vaporization due to heating and liquidification due to cooling according to the treatment using a purification apparatus shown in FIG. 1. Such resulting purified solvents have little radioactivity of approximately 0 CPM. When fabric is used for decontamination, it is incinerated and the resulting ash is confined in concrete. In this case, the volume of fabric to be used will be greatly reduced due to incineration. When the washing liquid used for said washing contains a substantial amount of cutting powder, the liquid is subjected to filtration.

Figure 1:
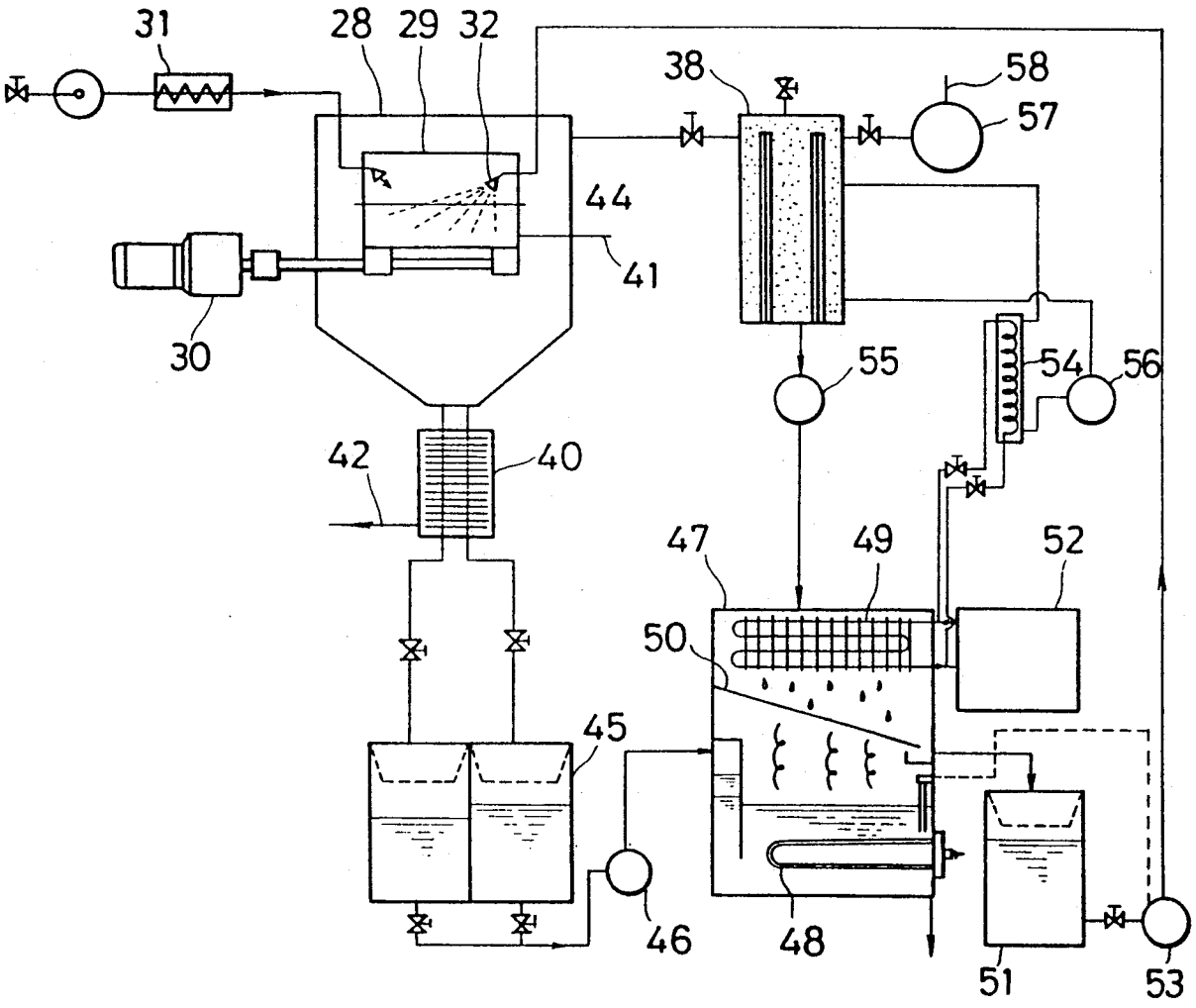
FIG. 1 shows a schematic representation of a decontaminating apparatus for embodying the present invention, wherein the material used for the decontamination of the substance contaminated with radioactivity is subjected to decontamination.
Figure 2:
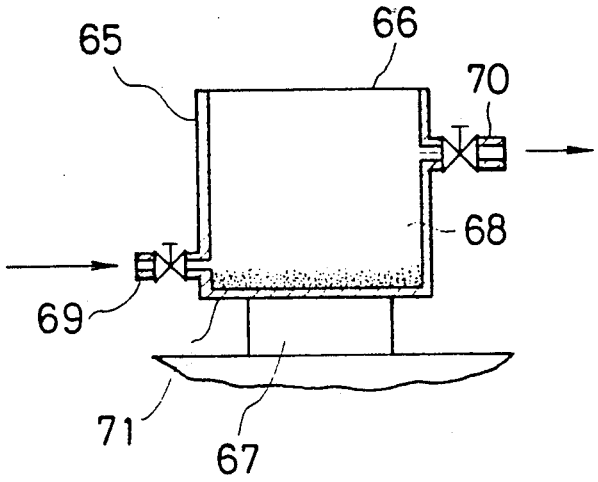
FIG. 2 shows a sectional view of an apparatus accompanying the apparatus shown in FIG. 1.
Figure 3:
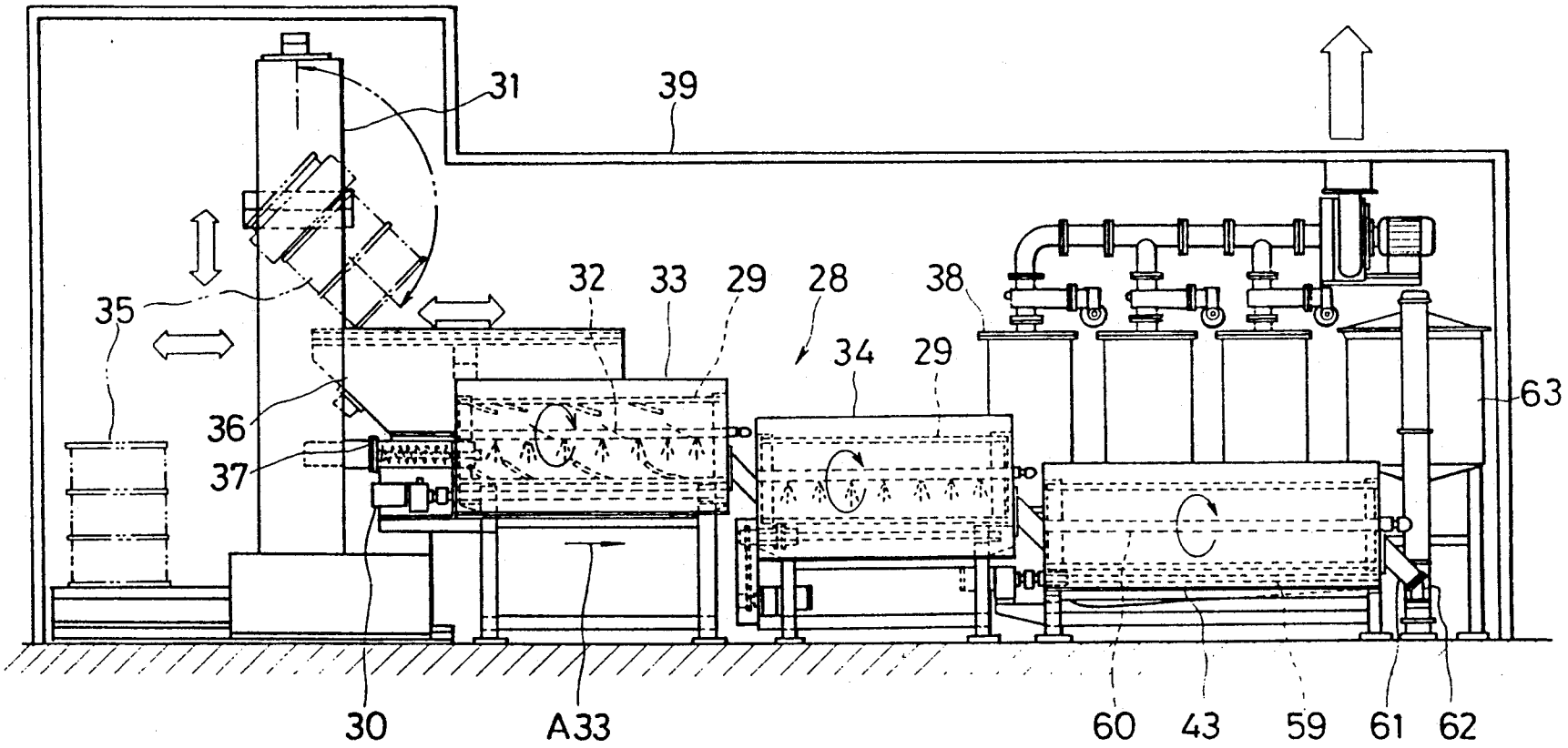
FIG. 3 shows a partial detailed view of the apparatus shown in FIG. 1.

The apparatus shown in FIGS. 1 and 2 are used for the removal of the grit used for said decontamination. In FIG. 1, numeral 28 indicates a washing means, and as an example a screen-lined drum of stainless steel 29 with universal rotation is equipped therewith and connected to driving means 30. Numerals 31 and 32 indicate grit supplying means and washing liquid spraying means, respectively. These means were formed as shown in FIG. 3. Washing means 28 comprises a pre-washing means 33 and a main washing means 34 having a difference between them in the level height. Said supplying means 31 was equipped with an elevator as shown in FIG. 3, and when a vessel 35 containing grit was lifted up to a specified position, it was inclined to feed the grit into a hopper 36. Numeral 37 indicates a screw. Said washing means 28 is connected to an adsorbing means 38 employing activated carbon. In said Figure, numeral 39 designates a confining means. In FIG. 1, numeral 40 indicates a filtration means with the details thereof omitted, wherein as an example cutting powder mixed with washing liquid is sandwiched by two pieces of filter fabrics and subjected to pressure at the external surfaces of the fabrics so as to be squeezed. Numerals 41 and 42 indicate a grit discharging port and a cutting powder discharging path, respectively. In FIG. 3, numeral 43 designates a dryer. Numeral 44 indicates organic solvent as a washing liquid, and methylene chloride as an example was employed. As for the washing liquid, Freon type of solvents, chlorinated organic solvents and alcohols as well as methylene chloride can be suitably used. Numerals 45, 46 and 47 indicate a tank, pump and purificating means, respectively.

The means 47 comprises a heater 48, a cooling means 49 and a recovering path 50, wherein methylene chloride is heated, vaporized, and allowed to be liquefied due to the contact of the cooling means 49, and the obtained liquid is permitted to dropped on the recovering path 50 to recover it in a tank 51. Numerals 52 and 53 indicate a freezer and pump, respectively.

In the following, said adsorbing means 38 will be illustrated. The means 38 uses activated carbon. It is allowed to employ suitably a conventional activated carbon absorbing apparatus. In the present invention a gas absorbing apparatus using activated carbon was used which was described in the invention previously invented and applied (patent application No. 76089/1989) by the applicants of this invention. An outline of this absorbing apparatus will be described but a graphically detailed description is omitted: when gas is absorbed, the activated carbon in an activated carbon vessel is cooled by a cooler 54 and methylene chloride gas is absorbed under the same condition. And when the gas is desorbed, said activated carbon is heated by a heater not illustrated, and under the same condition heated carrier air is supplied for the desorption using the same carrier air. Then the carrier air containing said gas is cooled below the boiling point thereof by a liquefying means not graphically shown to recover the solvent. At the next step, a part of the gas escaped from the liquefaction is cooled below its freezing point to freeze. The freezed gas is heated and liquefied to be recovered. Thus said gas is substantially recovered. And in FIG. 1, methylene chloride thus recovered as mentioned above is refluxed to the purifying means 47. Numerals 56 and 57 are blowers and numeral 58 is a discharging path for cleaned air.

In the following, the performance of the apparatus shown by FIGS. 1 and 3 will be described. The grit having cutting powder contaminated with radioactivity adhered is supplied to a pre-washing means 33 in the washing means 28 by a supplying means 31, then sprayed with methylene chloride from a spraying means 32 and washed during the rotation of a screen drum 29, and goes forward in the direction of arrow A in FIG. 3, and finally it drops into a main washing means 34 of the next step. In this case, methylene chloride dissolves epoxy resin coating well and zinc oxide coating. In the main washing means 34, it is similarly washed with methylene chloride to lose the cutting powder. The discharged washing liquid from said pre-washing means 33 reaches a filtration means 40 and is filtered to be separated from the cutting powder, then enters into a tank 45, and is transfered to a purifying means 47 to be purified. In this case, the purification is conducted by the use of vaporization with small amounts of the cutting powder contained in the solvent being completely removed. Accordingly the purified methylene chloride had 0 CPM and is sent to the main washing means 34.

In addition, since the heat of vaporization of an organic solvent is small, the purification thereof is performed easily and effectively.

The washing liquid used in main purifying means 34, therefore, containing cutting powder inevitably, is directly supplied to the pre-washing means 33 as a washing liquid by a pump not graphically shown.

The grit passing through the main washing means 34 enters into a drying means 43, then goes through a rotating screen drum 59 in the direction of arrow A 33, during which the grit is dried by hot air from a hot air means 60, then discharged from a discharging port 61 and sent into a tank 63 by a conveyer 62.

During which, air containing a gas, being contained in the pre-washing means 33, the main washing means 34 and the drying means 43, is sucked by the gas adsorbing means 38 using activated carbon connected to said three means. The gas adsorbed is liquified and refluxed to the purifying means 47. The grit contained in the tank 63 had a radioactivity of 30 CPM as an example.

In the following, numeral 65 shown in FIG. 2 indicates a washing apparatus using chelate liquid, wherein as an example a vessel 66 is equipped with an ultrasonic vibrating means 67. Numeral 68 indicates water containing chelate compound and surfactant, which is designed to be sent from an entrance 69 and discharged from a discharging port 70. As for a chelate compound, as an example, KIRESTOOL 7Q made by KIREST Chemistry Company Ltd. is used, and as for a surfactant, a nonionic surfactant R-430 made by Sumitomo 3M Company Ltd. were employed. Numeral 71, as mentioned before, designates the grit washed with methylene chloride.

Performance of the apparatus shown in FIG. 2 will be described. The grit washed by said washing means 28 is contained in a washing means 65 using chelate liquid, and is washed with a washing liquid 68 containing chelate agent by using the ultrasonic vibrating means 67. In this case, ions which are hindered with a chelate agent are manganese, zinc and iron ions.

And substances having radioactivity are effectively hindered with a chelate agent by ultrasonic vibration.

When this decontamination apparatus equipped with the ultrasonic vibration means is used with an organic solvent such as methylene chloride mentioned above, it also allows the substance having radioactivity to be decontaminated effectively.

Said washing liquid 68 enters at the entrance 69 and is discharged from the discharging port 70 wherein the chelate agent and surfactant are removed by a means not shown graphically. Then the grit which left the washing means using chelate liquid is dried by a drying means not graphically shown. The radioactivity of the resulting grit counted was 0 CPM.

The present invention is composed as described above, wherein a substance contaminated with radioactivity is shotblasted or sandblasted to remove the materials adhered to the surface of the substance; then the surface thereof is cleaned with liquid; the grit of said shotblast or sandblast is washed with an organic solvent; the organic solvent used for the washing is filtered; the organic solvent having residue removed is vaporized by heating; the vaporized solvent is liquified and recovered by cooling; and a result of these processes said substance contaminated with radioactivity can be effectively and significantly decontaminated. An additional washing of said grit by the washing apparatus using chelate liquid permits the radioactivity thereof to be almost removed, the volume of the substance contaminated with radioactivity to be greatly reduced, and the area of the wasted dumping place to be greatly decreased. A decontamination apparatus for the substance contaminated with radioactivity can provide an apparatus which will realize the effects above mentioned. The grit of shotblast or sandblast which is applied to the substance contaminated with radioactivity is washed with an organic solvent; the organic solvent used for the washing is filtered; the organic solvent having residue removed is heated and vaporized, the vaporized organic solvent is liquified by cooling to obtain purified solvent; and as a result of these processes the material used for the decontamination of the substance contaminated with radioactivity can be fully decontaminated. An additional washing of said grit by a washing apparatus using chelate liquid permits the radioactivity thereof to have a value count of 0 CPM by a Geiger counter; thus the material is recovered without producing waste as well as being available for re-use.

A decontamination apparatus for the material used for the decontamination of the substance contaminated with radioactivity can provide an apparatus endowed with the effects above mentioned. The substance contaminated with radioactivity is vibrated by a washing apparatus containing liquid as well as having an ultrasonic vibrating means to allow said substance to be effectively decontaminated.

What is claimed is:

1. A method of decontaminating an article contaminated with radioactivity, comprising:

applying shotblast or sandblast to the article contaminated with radioactivity to remove materials adhered to the surface of the article;

cleaning the surface of the article with a liquid;

washing grit resulting from the application of shotblast or sandblast to the article with an organic solvent;

filtering the organic solvent used for washing the grit;

vaporizing the organic solvent by heating to remove residue from the organic solvent; and cooling and liquefying the vaporized organic solvent for recovery.

2. A method according to claim 1, including further washing said washed grit by using a liquid containing a chelate compound.

3. A method for decontaminating a material used for decontaminating an article contaminated with radioactivity, comprising:

washing grit of shotblast or sandblast resulting from shotblasting or sandblasting the article contaminated with radioactivity with organic solvent;

filtering the organic solvent used for washing the grit;

vaporizing the filtered organic solvent by heating; and cooling and liquefying the vaporized organic solvent.

4. A method according to claim 3, including washing said washed grit with a liquid containing a chelate compound.

5. A method for decontaminating an article contaminated with radioactivity, comprising:

blasting the article with material for removing radioactivity contamination therefrom;

washing the material after the blasting operation in a liquid while ultrasonically treating the liquid and material.

6. A method for decontaminating a material contaminated with radioactivity according to claim 5, wherein the material is grit of shotblast or sandblast.

7. A method of decontaminating shotblast or sandblast grit contaminated with radioactivity resulting from a process of shotblasting or sandblasting a substance or article contaminated with radioactivity, said method comprising:

providing a driven cylindrical screen drum rotatable about a horizontal axis;

providing a plurality of jet tubes arrayed in the direction of the horizontal axis of said screen drum and having downwardly directed jet portions;

accommodating said screen drum in a decontamination chamber having a liquid collecting port at the bottom thereof;

charging said screen drum with the grit contaminated with radioactivity;

rotating said screen drum while downwardly jetting a decontamination liquid from the jet portions of said jet tubes so that a portion of the grit is raised from one side of said screen drum, and at the end of the upward movement of the portion of grit in said screen drum, the portion of grit naturally drops down onto other grit remaining in a lower portion of said drum, so as to circulate and manipulate the grit to continuously change the grit surface subjected to the jet portions to facilitate the decontamination of the grit by the decontamination liquid; and separating the decontamination liquid from the grit by said rotating screen drum and collecting the decontamination liquid in said decontamination chamber for draining via said liquid collection port.

8. A method according to claim 7, including:

drying the grit treated in said screen drum; and charging the dried grit in a chelate solution decontamination apparatus having an ultrasonic vibration device, so that the grit is further decontaminated by the chelate solution which flows around the particles of the grit while the grit is being vibrated by said ultrasonic device.

9. A method according to claim 7, wherein the decontamination liquid is methylene chloride.

10. A method according to claim 8, wherein the decontamination liquid is methylene chloride.

11. A method according to claim 9, including ultrasonically treating the grit in a chelate solution.

12. A method of decontaminating a radioactive contaminated article, comprising:

blasting the article with a material to remove radioactive contamination from the article; and radioactive decontaminating the material used in the blasting operation by treating the material with liquid and ultrasonic waves to remove contamination from the material.

13. A method according to claim 12, wherein the material is treated in a vessel containing the liquid, and the ultrasonic waves are applied to the vessel.

14. A method according to claim 13, wherein the material is immersed in the liquid contained in the vessel.

* * * * *